United States Patent [19]

Dery

[11] Patent Number: 5,026,290

[45] Date of Patent: Jun. 25, 1991

[54] ELECTRICAL CONNECTOR FOR ELECTRICALLY INTERCONNECTING NON-PARALLEL SUBSTRATES

[75] Inventor: Ronald A. Dery, Winston-Salem, N.C.

[73] Assignee: AMP Incorporated, Harrisburg, Pa.

[21] Appl. No.: 563,005

[22] Filed: Aug. 6, 1990

[51] Int. Cl.[5] ..... H01R 9/09

[52] U.S. Cl. ..... 439/65; 439/67; 439/494; 439/591

[58] Field of Search ..... 439/65-67, 439/69, 74, 77, 493, 494, 499, 591

[56] References Cited

U.S. PATENT DOCUMENTS

| | | | |
|---|---|---|---|
| 3,638,163 | 1/1972 | Loosme | 339/17 M |
| 3,795,884 | 3/1974 | Kotaka | 439/591 |
| 3,985,413 | 10/1976 | Evans | 339/17 LM |
| 4,173,381 | 11/1979 | Allmark et al. | 339/17 LM |
| 4,227,767 | 10/1980 | Mouissie | 339/176 MF |
| 4,693,529 | 9/1987 | Stillie | 439/67 |
| 4,798,541 | 1/1989 | Porter | 439/67 |
| 4,934,942 | 6/1990 | Casciotti | 439/65 |

*Primary Examiner*—Paula A. Bradley
*Attorney, Agent, or Firm*—Allan B. Osborne

[57] ABSTRACT

An electrical connector (18) for electrically interconnecting non-parallel substrates (10,12) is disclosed. The connector (18) includes a contact element (24) formed from a single length of flexible, circuit carrying film (40) wrapped around two or more spaced apart coil springs (42) with each wrapped spring provided a segment (60). The contact element (24) is carried in a housing (20) with the segments (60) received in interconnected channels (26) in adjacent surfaces (28) of the housing against which the substrates (10,12) are mounted for electrical engagement with the segments (60).

5 Claims, 2 Drawing Sheets

16
12
10
24
40
28a
26a
60
34
16
28b
42
54
36
26b
18
52
44
30a
30b
20
52
42
40
16
26c
28c
14

60
24
44
46
48
42
40

ELECTRICAL CONNECTOR FOR ELECTRICALLY INTERCONNECTING NON-PARALLEL SUBSTRATES

FIELD OF THE INVENTION

The invention disclosed herein relates to electrical connectors for electrically interconnecting circuits on two or more substrates and which may be at an angle to each other.

BACKGROUND OF THE INVENTION

Electrical connectors for electrically interconnecting two parallel substrates have been known as exemplified in U.S. Pat. Nos. 3,638,163, 3,795,884 and 3,985,413. In these known connectors, the substrates being electrically interconnected are parallel to and spaced from each other. It is now proposed to provide an electrical connector which will electrically interconnect two and three substrates wherein one substrate is not parallel to the others.

SUMMARY OF THE INVENTION

According to the invention, an electrical connector is provided for electrically interconnecting two nonparallel substrates. The connector comprises a housing having channels on two adjacent, non-parallel surfaces and a passage interconnecting the channels and a contact element comprising a flexible circuit carrying film extending between and wrapped around two spaced apart coil springs. The contact element is positioned in the housing with the coil springs received in the channel and the circuits on the film facing outwardly of the channels for electrically engaging substrates placed against the adjacent, non-parallel surfaces.

DESCRIPTION OF THE INVENTION

Figure 1:
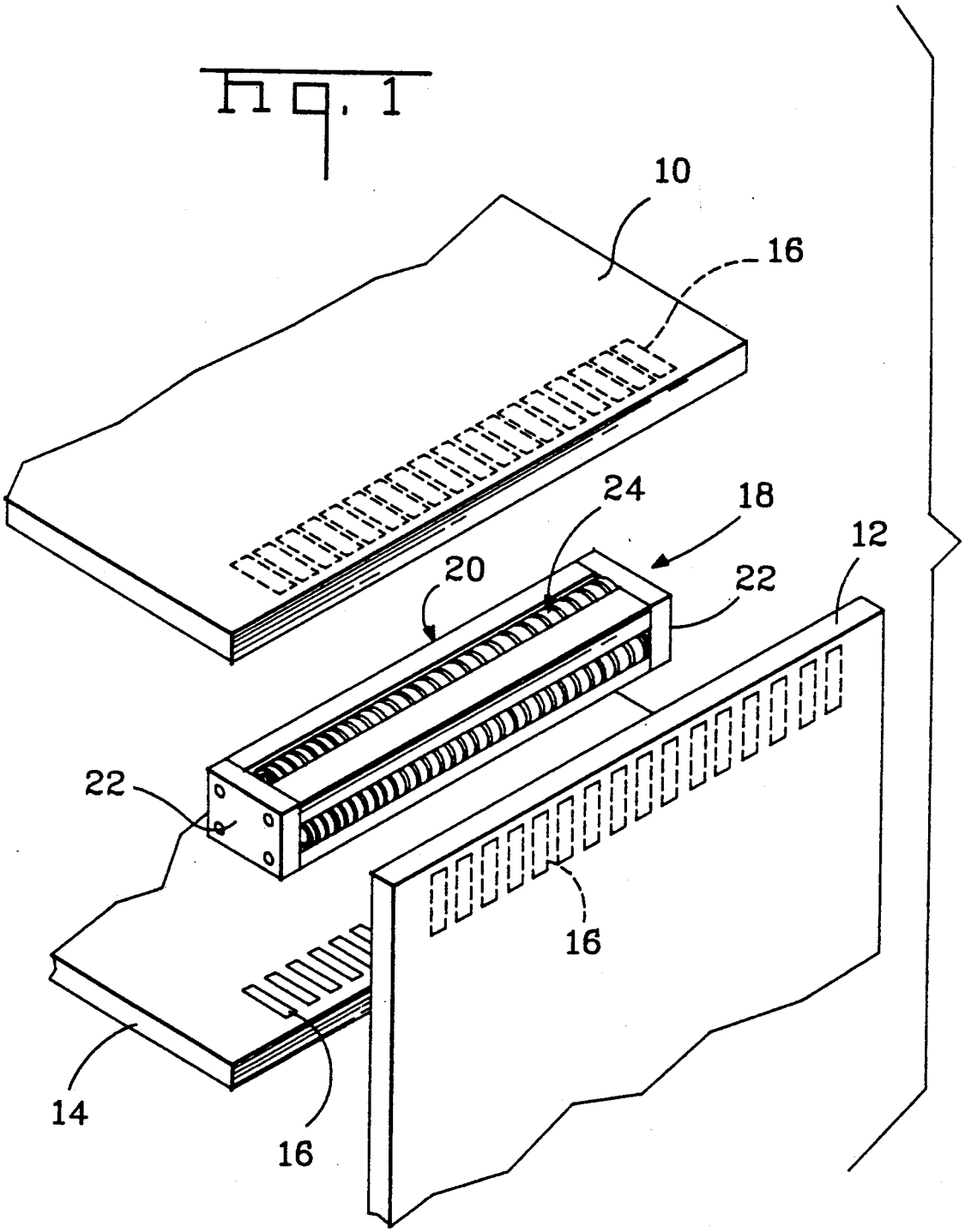
FIGS. 1 is a perspective view of an electrical connector of the present invention and three substrates, one of which is normal relative to the others, which are to be electrically interconnected to each other by the connector.

With reference to the drawings, substrates 10, 12 and 14 include conductive surface pads 16 which are to be electrically interconnected by means of electrical connector 18 constructed in accordance with one embodiment of the present invention. Substrates include back planes, printed circuit cards and boards and other like devices.

Connector 18 includes housing 20, end blocks 22 and contact element 24. Housing 20 and blocks 22 are preferably made from dielectric material but could be made from a conductive material and coated in an insulating material.

In the embodiment illustrated housing 20 is provided with three elongated channels **26*a*, 26*b* and 26*c*. Channels 26 are located in three adjacent surfaces 28*a*, 28*b* and 28*c*. As is obvious from FIG. 2 particularly, channel 26*b* and surface 28*b*** are not parallel to the other channels and surfaces.

Passage **30*a* interconnects channels 26*a*, 26*c* and passage 30*b* connects channel 26*b* with passage 30*a*. Thus, all channels 26 are in communication with each other through passages 30**.

Holes 34 extend longitudinally through housing 22 adjacent four corners and receive therein rods 36 which secure end blocks 22 to housing 20.

Contact element 24 is formed from a flexible, circuit carrying film 40 wrapped around three coil springs 42 which are spaced from each other. Film 40 is a typical film available from a number of manufacturers; e.g., the 3M Company of Minneapolis, Minn. Circuits 44 are provided on one surface 46 of film 40 which is made from a dielectric material such as a polyamide. Circuits 44 are parallel and spaced apart on a predetermined pitch.

Figure 3:
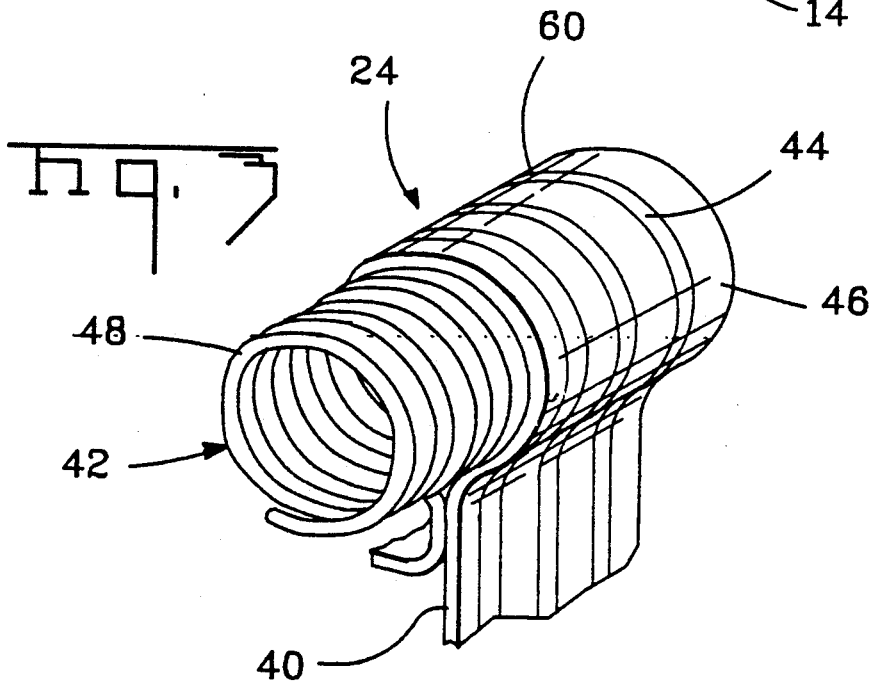
FIG. 3 is a perspective view of one segment of the contact element of the connector.

Coil springs 42 may be of the ordinary helical type or one wherein the individual coils 48 are canted; i.e., each coil 48 lie at an angle relative to an axis. One type of canted coil spring is made and sold by Bal Seal Engineering Co. of Santa Ana, Calif. FIG. 3 shows a canted coil spring 42.

Figure 2:
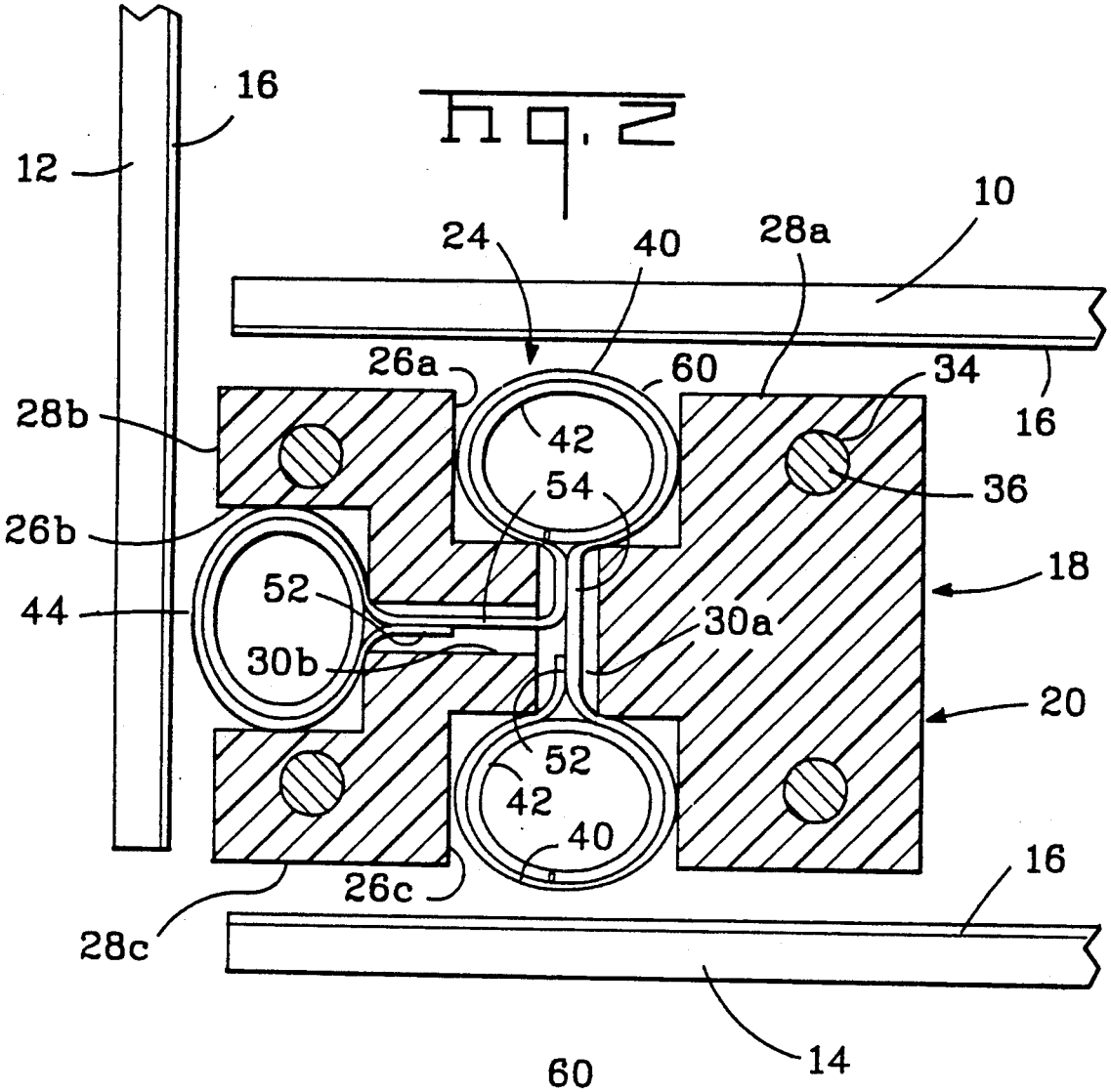
FIG. 2 is a side sectioned view of the connector of FIG. 1 and of the three substrates.

With respect to the illustrated contact element 24, springs 42 are wrapped with film 40 extending between and from each spring. The drawing of FIG. 2 shows one manner in which the springs 42 are wrapped; i.e., free ends 52 of film 40 are secured to intervening lengths 54 of the film extending between springs 42. Circuits 44 face outwardly.

Film 40 may be bonded to springs 42 if desired. Further, a layer of some material (not shown) may be positioned between each spring 42 and film 40.

As shown in FIG. 2, contact element 24 is positioned in housing 20 so that each segment **60*a*, 60*b*, 60*c*, comprising one wrapped coil spring, occupies respectively channel 26*a*, 26*b* and 26*c*. Segments 60 are electrically interconnected by circuits 44 of film 40 so that upon pressing substrates 10, 12, 14 against surfaces 28*a*, 28*b*, 28*c* respectively, conductive pads 16** are electrically commoned or interconnected.

Contact element 24 is loaded into housing 20 from one end with centering thereof provided by adjustment means (not shown) for example on the removable end blocks 22, or by other suitable stop means (not shown), in the channels 26.

From the foregoing, it will be apparent to those skilled in the art that housing 20 may have any number of channels 26 and contact element 24 may have any number of segments 60. Further, contact element 24 may have fewer segments 60 than there are channels 26. Also housing 20 may have a number of sets of channels 26 with channels 26 in each set interconnected but each set isolated from other sets.

Other modifications include card guides (not shown) incorporated into end blocks 22.

In the drawings, connector 18 is shown as electrically interconnecting three substrates with substrate 12 being normal to substrates 10,14. One use contemplated is that substrate 12 is a back plane with a plurality of connectors 10 mounted thereon and with substrates 10,14 therebetween.

Further, while housing 20 is shown as having surfaces at right angles to each other, it could have surfaces at angles other than ninety degrees.

As can be discerned, an electrical connector for electrically interconnecting non-parallel substrates has been disclosed. More particularly the connector includes a contact element formed by wrapping a single length of flexible, current carrying film around two or more spaced apart coil springs to define electrically interconnected segments. The contact element is carried in a housing with the several segments received in interconnected channels in the surfaces so that substrates which are positioned against those surfaces are electrically interconnected. have fewer segments 60 than there are channels 26. Also housing 20 may have a number of sets of channels 26 with channels 26 in each set interconnected but each set isolated from other sets.

Other modifications include card guides (not shown) incorporated into end blocks 22.

In the drawings, connector 18 is shown as electrically interconnecting three substrates with substrate 12 being normal to substrates 10,14. One use contemplated is that substrate 12 is a back plane with a plurality of connectors 10 mounted thereon and with substrates 10,14 therebetween.

Further, while housing 20 is shown as having surfaces at right angles to each other, it could have surfaces at angles other than ninety degrees.

As can be discerned, an electrical connector for electrically interconnecting non-parallel substrates has been disclosed. More particularly the connector includes a contact element formed by wrapping a single length of flexible, current carrying film around two or more spaced apart coil springs to define electrically interconnected segments. The contact element is carried in a housing with the several segments received in interconnected channels in the surfaces so that substrates which are positioned against those surfaces are electrically interconnected.

I claim:

1. An electrical connector for electrically interconnecting two parallel substrates and one non-parallel substrate, said connector comprising:

a housing having a channel on each of two parallel surfaces and a third channel on another surface not parallel relative to the two parallel surfaces and a first passage through said housing extending and open to said channels on said two parallel surfaces and a second passage extending and open to said third channel and said first passage; and a contact element comprising a flexible, circuit carrying film wrapped around and extending between three, spaced apart coil springs with circuits on the film facing outwardly, said contact element being positioned in said housing with each spring being received in respective said channels and said film extending between said springs being received in said passages, said circuits extending outwardly from said channels to electrically engage substrates placed against said surfaces of said housing.

2. The connector of claim 1 wherein said housing includes a second channel on one of said surfaces and one of said passages extend to said second channel and said contact element includes a fourth coil spring with said film wrapped therearound for being received in said second channel on one of said surfaces.

3. The connector of claim 1 wherein said coil springs are canted.

4. The connector of claim 3 wherein said channels and passages are open at one end of said housing to receive said contact element.

5. The connector of claim 4 further including means for removably closing said one end.

* * * * *